United States Patent [19]

Möller et al.

[11] 4,045,945

[45] Sept. 6, 1977

[54] APPARATUS FOR THE STERILE FILLING OF FOODS INTO CONTAINERS

[75] Inventors: Erwin Möller, Wuppertal-Barmen; Franz Hubert Bausch, Wuppertal-Ronsdorf, both of Germany; Martin Frölich, Gumlingen BE, Switzerland

[73] Assignee: Firma Hamba-Maschinenfabrik Hans A. Müller, Wuppertal-Vohwinkel, Germany

[21] Appl. No.: 349,532

[22] Filed: Apr. 9, 1973

[30] Foreign Application Priority Data

Apr. 17, 1972 Germany ..... 2218585

[51] Int. Cl.[2] ..... B65B 31/02; B65B 55/10

[52] U.S. Cl. ..... 53/167; 53/282

[58] Field of Search ..... 53/37, 167, 282; 21/58, 21/78, 80, 91, 92-94; 99/467; 219/201, 279

[56] References Cited

U.S. PATENT DOCUMENTS

| | | | |
|---|---|---|---|
| 2,419,875 | 4/1947 | Birdseye | 34/17 |
| 2,685,520 | 8/1954 | Martin | 53/25 X |
| 3,478,489 | 11/1969 | Meisner | 53/167 |
| 3,723,060 | 3/1973 | Lisiecki | 21/58 X |

*Primary Examiner*—Robert Louis Spruill

*Attorney, Agent, or Firm*—Ernest G. Montague; Karl F. Ross; Herbert Dubno

[57] ABSTRACT

An apparatus for the sterile filling of products into cup-shaped containers, which comprises an endless conveyor passing containers in sterile condition in succession through treatment stations including a filling station, a lid-applying station, a sealing station and an ejection station. A large sterile chamber formed beneath an applied covering hood and enclosing all said treatment stations is provided; and before the treatment stations, as seen in the direction of travel of said conveyor, and in above the conveyor there are of a finished-container magazine and a short-path, quick-acting sterilization station including a sterilizing-agent sprayer and sterilizing-agent drier is above the conveyor and enclosed by the covering hood.

2 Claims, 1 Drawing Figure

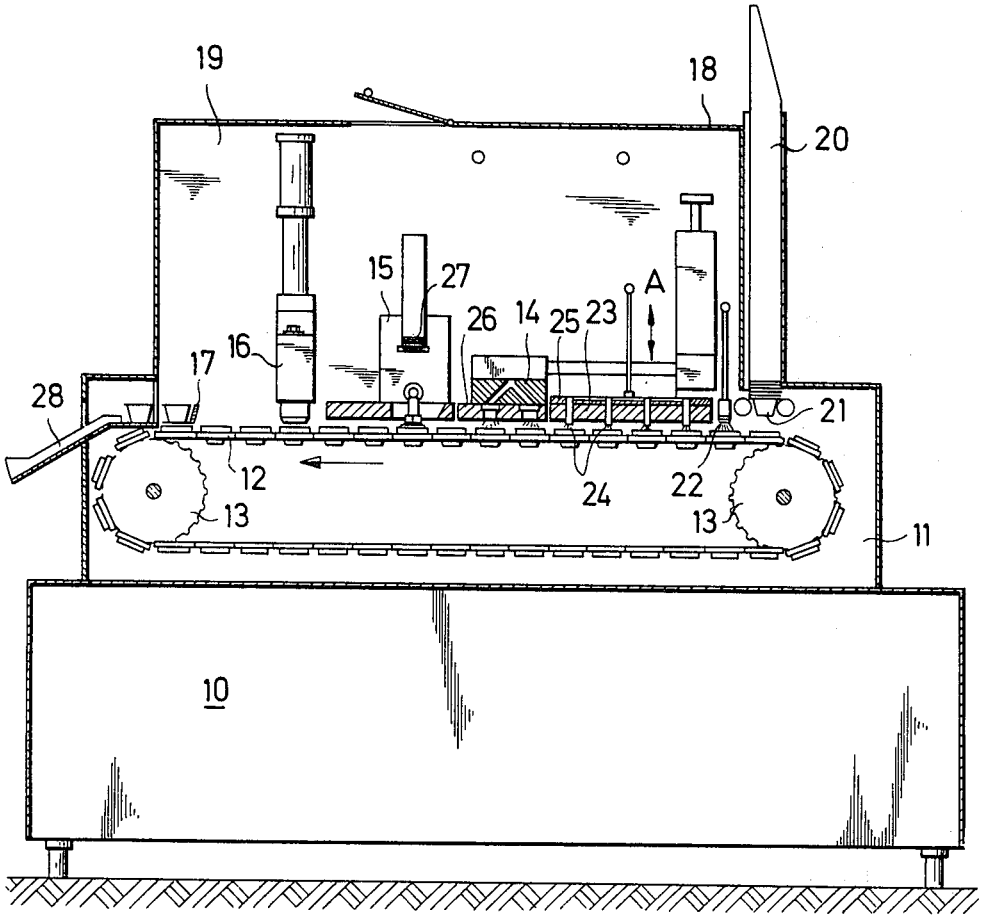
19
18
20
15
27
A
26
14
25
23
16
17
28
21
12
24
22
13
13
11
10

APPARATUS FOR THE STERILE FILLING OF FOODS INTO CONTAINERS

The present invention relates to an apparatus for the sterile filling of products into cup-shaped finished containers, which pass in sterile condition, an endless conveyor in succession through a filling station, a lid-applying station, a sealing station and an ejection station, all the treatment stations being contained within sterile chamber formed below, covering hood.

In apparatus for the sterile filling of products, there is a real problem of bringing the finished containers ready for filling and pre sterilized to the filling station in absolutely dry condition, i.e. in condition absolutely free of sterilizing agent. This problem is greater the deeper and larger the empty finished containers are. Therefore, it is necessary for dependable drying, that the finished containers which are to be made sterile must pass through a relatively long drying path before reaching the filling station, which naturally results in a considerable structural length for such an apparatus.

One solution is known, for instance, wherein outside the filling machine proper, i.e. before entering the machine, a drum storage is provided in which the finished containers are fed, sterilized and dried. By this drum magazine, assurance is provided for a sufficiently long path for the drying of the containers, so that the finished containers can arrive at the filling station in a dry state. The disadvantage, however, consists of the separate and rather long structure required for the previously known device in order to achieve the desired drying of the finished containers.

The technical object of the present invention resides in obtaining sufficient sterilization with the necessary drying in a short apparatus.

It is one object of the present invention to obtain in advantageous fashion before the treatment stations provided in the space above of the conveyor, as seen in the direction of conveyor travel, the discharge opening of a finished-container magazine as well as a short-path, quick-acting sterilizing station consisting of a sterilizing-agent sprayer and sterilizing agent drier, all in the space above the conveyor and enclosed within the covering hood.

It is another object of the present invention to provide an apparatus wherein a finished-container delivery magazine as well as a sterilizing-agent sprayer and a sterilizing-agent drier are arranged within the machine before the actual filling device; and which are well suited for relatively low, small finished containers having only small container surface, since this brief action is fully effective in the case of such containers. In this apparatus the finished containers enter the machine and pass in front of a spray nozzle which produces a mist of sterilizing agent, and after this application of the mist of sterilizing agent, there is a combination drying device with previously unobtained absolutely effective and extremely intensive combined drying action.

This sterilizing-agent combination drier which consists of a heating plate, extending in the longitudinal direction of the conveyor over a plurality of conveyor cells and in transverse direction over all adjacent conveyor cells and of drying nozzles arranged at cell distances apart which pass through the heating plate and can be fed with sterile hot air is able, particularly due to its combination drying action, to dry finished containers absolutely dependably in a previously unobtainable brief of time and over an extremely short path in such manner that when it is desired to sterilize small, low, finished containers before they are filled, a relatively short construction of the machine can be attained for the first time.

In the new combination drying, the containers which had been wetted by a mist of sterilizing agent are subjected from the beginning of the drying to the combination action of a heat action from the heating plate which, assisted by the nozzle which blow sterile hot air, is able in a relatively short time to dry the containers in an absolutely dependable manner.

Since, viewed in the longitudinal direction of the conveyor, the heating plate extends over several conveyor cells and a plurality of nozzles blowing sterile hot air are also arranged one after the other in longitudinal direction as well as alongside of each other, each sprayed container is subjected within the area of the combination dryer to this combination drying action several times, so that after it leaves the drying zone, each container — corresponding to practical requirements — can be brought absolutely dry to the filling apparatus.

In this way now for the first time small, low containers with only a small container surface can be easily and rapidly sterilized and dried and furthermore, by the use of a mist of sterilizing agent and of a more intensive combination drying within a relatively short time and over a relatively short path.

In accordance with another proposal of the present invention, the sterile-air drying nozzles are all arranged on a nozzle support which can be raised and lowered jointly with the nozzles and is arranged in a plane above the heating plate.

By this means of arranging blow nozzles which can be fed with sterile hot air in such a manner that they can be raised and lowered, the nozzles can be caused to extend over at least a part of their height into the containers to be dried, thus assisting the drying action with sterile hot air.

In this new apparatus, as a result of the combination effect, containers sprayed with sterilizing agent can be dried over a relatively short path so that filling devices for sterile filling of relatively low, small containers can be built in a short length which was heretofore not obtainable, which is of inestimable importance. Due to the fact that the finished containers are not only fed within the machine but are also made sterile in the machine, no special attachments — such as the known sterilizing drums or the like — are required any longer.

Finally, it is further proposed in this connection that the heating plate can be continued into the range of action of the filling station, so as to be able to retain the thermal action on the containers. In this way the upper edge of the container on which a lid is placed is to be also subjected to the action of heat until practically directly in the lid-applying station, so that the assurance that the edge of the container remains absolutely dry is also increased.

Summarizing, it is thus possible by means of the present invention, to provide an apparatus in which it is possible, over a relatively short structural length and within the machine only in the space above of the conveyor, to feed containers preferably of only slight depth and small capacity, and furthermore not only to sterilize them sufficiently, but also to dry them sterile and keep them sterile and dry up to the filling station. As a result of this, the new apparatus is far superior to all previously known sterilization arranged outside the machine.

With these and other objects in view which will become apparent in the following detailed description, the present invention, will be clearly understood in connection with the drawing which is shown as an example only in which the only FIG. is a longitudinal section of the machine.

Referring to the drawing, there is first provided on a machine frame 10 a housing 11, in which an endless conveyor 12 is driven around two sprocket wheels 13. Above the upper course of the conveyor chain 12, there is a filling station 14, a lid-applicator station 15, a sealing station 16 and an ejector 17. All treatment stations 14–17 of the apparatus are covered by a covering hood 18, which thus forms a large sterile space 19 below it.

As can be seen, before the actual filling station 14, as seen in the direction of travel of the conveyor 12, there is provided a magazine 20 for the delivery of finished containers 21, a sterilizing-agent sprayer 22, as well as a drying device 23, 24. The sterilizing-agent sprayer is exemplified as a nozzle 22 which produces a sterile mist. Immediately adjoining this nozzle there is arranged the sterilizing-agent combination drier 23, 24.

This sterilizing-agent combination drier consists of a heating plate 23 which extends in the longitudinal direction of the conveyor 12 over a plurality of conveyor cells or successive container positions — in the present example over four conveyor cells. It furthermore extends over the entire width of the conveyor chain which may be provided with a plurality of rows of conveyor cells or container positions lying alongside of each other in widthwise direction. Furthermore, a plurality of blow nozzles 24 lying behind each other in the longitudinal direction of the conveyor chain are provided spaced apart by a distance equal to the spacing of the conveyor cells, a number of such blow nozzles equal to the number of rows of conveyor cells being provided alongside of each other.

The heating plate 23 can be heated by any known heating means of which there are many, and the blow nozzles 24 can be fed with sterile hot air from an enternal source generated by known methods of heating and compressing gases, so that a combination drying action occurs. Any deposited splatterings of the sterile spray mist are immediately evaporated the hot heating plate 23.

All blow nozzles 24 are provided on a common nozzle support 25, which can be raised and lowered in the direction indicated by the arrow "A", so that the blow nozzles which are guided displaceably in longitudinal direction also in the heating-plate block 23 can extend into the containers 21 to be dried at least over a part of their axial height. Specifically in this way there is obtained a previously unachieved concentrated intensive drying in combination with the heating action of the heating plate.

As can further be seen, the heating plate 23 is continued by also heating plate body 26 in the region of the filling station 14, so that in this region too the heating effect on the containers which are to be filled is maintained.

Sterilized, filled containers after filling pass into a lid-applying station 15, where the lids 27 are fitted. These lids are then connected homogeneously with the upper edge of the container in the adjoining sealing station 16. An ejector 17 brings the finished containers out of the conveyor cells onto a conveyor 28 which conveys the filled containers out of the machine.

Of course the embodiment shown and described is to be considered merely one possible embodiment for reduction to practice of the present invention, which, is not to be limited solely to this embodiment. Various other embodiments are also possible within the scope of the present invention.

This is particularly true of the combination drier, in which the heating plate 23 showing as a single block could be formed from individual plates placed alongside of each other. Furthermore, as to the blow nozzles, instead of the adjustable and movable joint arrangement on a nozzle support, each could be individually in the longitudinal direction if this should be advantageous for reasons of drying technique or similar reasons. These and similar solutions are considered to fall within the scope of the present invention of a concentrated intensive sterilizing and drying on very short path within the machine.

We claim

1. In an apparatus for the sterile packing of foods in cup-shape containers comprising an endless conveyor defining a transport path, a filling station along said path for depositing food in said containers, a lid-applying station downstream of said filling station along said path for applying a lid to each of the filled containers, a sealing station along said path downstream of the lid-applying station sealing the applied lid to each container, said containers after sealing of said lids being ejected from said path, the improvement which comprises:

a hood overlying said conveyor and enclosing all of said stations to define a sterile chamber;

a magazine along said path for depositing said containers on said conveyor upstream of said filling station;

spray means disposed downstream of said magazine along said path and within said chamber for spraying said containers with a sterilizing fluid; and a drying means between said spraying means and said filling station along said path for drying the fluid in said containers, said drying means including means for blowing a gas onto said containers and radiant-heating means confronting said containers on said conveyor, said conveyor being provided with a multiplicity of cells each receiving a respective container, said drying means comprising a heating plate extending longitudinally in the direction of displacement of the conveyor over a plurality of conveyor cells and a plurality of blow nozzles spaced apart in said direction with a distance equal to the spacing of said cells and extending through said plate, said drying means further comprising means for feeding said nozzles with sterile air.

2. The improvement defined in claim 1, further comprising means for shifting said nozzles toward and away from said conveyor.

* * * * *